US008658005B2

(12) United States Patent
Goto et al.

(10) Patent No.: US 8,658,005 B2
(45) Date of Patent: Feb. 25, 2014

(54) ELECTRICAL-DISCHARGE SURFACE-TREATMENT METHOD

(75) Inventors: Akihiro Goto, Tokyo (JP); Masao Akiyoshi, Tokyo (JP); Katsuhiro Matsuo, Nagoya (JP); Hiroyuki Ochiai, Tokyo (JP); Mitsutoshi Watanabe, Tokyo (JP); Takashi Furukawa, Tokyo (JP)

(73) Assignees: Mitsubishi Denki Kabushiki Kaisha, Tokyo (JP); Ishikawajima-Harima Heavy Industries Co., Ltd., Tokyo (JP)

( * ) Notice: Subject to any disclaimer, the term of this patent is extended or adjusted under 35 U.S.C. 154(b) by 1304 days.

(21) Appl. No.: 12/062,984

(22) Filed: Apr. 4, 2008

(65) Prior Publication Data

US 2008/0230374 A1 Sep. 25, 2008

Related U.S. Application Data

(60) Division of application No. 11/298,628, filed on Dec. 12, 2005, now Pat. No. 7,641,945, which is a continuation-in-part of application No. PCT/JP2004/000838, filed on Jan. 29, 2004.

(30) Foreign Application Priority Data

Jun. 11, 2003 (JP) ..... 2003-166011

(51) Int. Cl.
*C23C 14/34* (2006.01)

(52) U.S. Cl.
USPC ..... 204/192.38; 427/580

(58) Field of Classification Search
USPC ..... 204/192.38; 427/580
See application file for complete search history.

(56) References Cited

U.S. PATENT DOCUMENTS

| | | | | |
|---|---|---|---|---|
| 5,858,479 | A | 1/1999 | Saito et al. | |
| 6,602,561 | B1 * | 8/2003 | Moro et al. | 427/580 |
| 7,537,808 | B2 * | 5/2009 | Goto et al. | 427/580 |
| 2005/0211165 | A1 | 9/2005 | Goto et al. | |

FOREIGN PATENT DOCUMENTS

| | | | |
|---|---|---|---|
| EP | 0338574 | A1 | 10/1989 |
| EP | 0548932 | A1 | 6/1993 |
| JP | 5-148615 | A | 6/1993 |
| JP | 07-070761 | A | 3/1995 |
| JP | 07-197275 | A | 8/1995 |
| JP | 8-300227 | A | 11/1996 |

(Continued)

OTHER PUBLICATIONS

Machine Translation of JP 05-148615 dated Jun. 1993.*
Formation of hard layer on metallic material by EDM Akihiro Goto et al. Pro. International Symposium for Electro-machining (ISEM 12).
Development of Electrical Discharge Coating Method Akihiro Goto et al. Pro. International Symposium for Electro-machining (ISEM 13).
Japanese Office Action dated May 7, 2008.
European Search Report dated Aug. 22, 2008.

*Primary Examiner* — Rodney McDonald
(74) *Attorney, Agent, or Firm* — Sughrue Mion, PLLC

(57) ABSTRACT

An electrode for an electrical-discharge surface-treatment method is molded with a metallic powder or a metallic compound powder having an average grain diameter of 6 micrometers to 10 micrometers. A coat on a surface of a workpiece is formed with a material constituting the electrode or a substance that is generated by a reaction of the material due to a pulse-like electrical discharge. The coat is built up with a material containing metal as a main constituent under conditions of a width of a current pulse for the pulse-like electrical discharge in a range of 50 microseconds to 500 microseconds and a peak of the current pulse equal to or less than 30 amperes.

20 Claims, 13 Drawing Sheets

(56) References Cited

FOREIGN PATENT DOCUMENTS

| | | | |
|---|---|---|---|
| JP | 11-000827 | A | 6/1999 |
| JP | 11-229159 | A | 8/1999 |
| JP | 11-264080 | A | 9/1999 |
| JP | 2002-20882 | A | 1/2002 |
| JP | 2002-370127 | | 12/2002 |
| WO | WO 99/58744 | * | 11/1999 |
| WO | WO 99/58744 | A1 | 11/1999 |

* cited by examiner

FIG.12

| PULSE WIDTH (μs) / AVERAGE GRAIN DIAMETER(μm) | ~50 | 5~100 | 50~500 | 500~ |
|---|---|---|---|---|
| ~3 | DENSE THICK FILM CAN BE FORMED | THICK FILM CAN BE FORMED BUT THE FILM IS POROUS | IT IS DIFFICULT TO FORM THICK FILM | TREATMENT IS UNSTABLE (E.G , SHORT CIRCUIT OCCURS) |
| 2~6 | THICK FILM CAN BE FORMED BUT THE FILM IS POROUS | DENSE THICK FILM CAN BE FORMED | THICK FILM CAN BE FORMED BUT THE FILM IS POROUS | TREATMENT IS UNSTABLE (E.G., SHORT CIRCUIT OCCURS) |
| 6~10 | COARSE POWDER ONLY DEPOSITS ON WORK | THICK FILM CAN BE FORMED BUT THE FILM IS POROUS | DENSE THICK FILM CAN BE FORMED | THICK FILM CAN BE FORMED BUT THE FILM IS POROUS (TREATMENT IS UNSTABLE WHEN PULSE WIDTH BECOMES LONGER) |

ELECTRICAL-DISCHARGE SURFACE-TREATMENT METHOD

This is a divisional of application Ser. No. 11/298,628 filed Dec. 12, 2005, which is a Continuation-in-Part Application of PCT Application No. PCT/JP2004/000838 filed Jan. 29, 2004, which claims priority from Japanese Patent Application No. 2003-166011. The entire disclosures of the prior applications are hereby incorporated by reference.

BACKGROUND OF THE INVENTION

1) Field of the Invention

The present invention relates to a technology for electrical-discharge surface treatment using a molded powder obtained by molding a metallic powder or a metallic compound powder as an electrode, and a pulse-like electrical discharge caused between the electrode and a workpiece.

2) Description of the Related Art

In a surface treatment technology for forming a coat on a workpiece through a pulse-like electrical discharge from an electrode, which is a green compact obtained by compression-molding a powder material, a technology for forming, at temperature close to the normal temperature, a thin hard coat containing ceramics as a main constituent is established (see, for example, International Publication Number WO 99/58744).

In the technique disclosed in the above literature, a hard ceramic coat is formed on a surface of a workpiece by controlling supply of an electrode material by electrical discharge while keeping an electrode hard to some extent and melting the supplied material sufficiently. However, thickness of a coat, which can be formed by the method, is limited to as thin as about 10 micrometers.

Examples of a technology for forming a thick film through the electrical-discharge surface treatment include a technology for forming a coat containing carbide as a main constituent on a surface of aluminum (see, for example, Japanese Patent Application Laid-Open No. H7-70761), a technology for forming a coat containing carbide as a main constituent (see, for example, Japanese Patent Application Laid-Open No. H7-197275), and a technology for forming a thick film having thickness of about 100 micrometers by extending an electrical-discharge pulse width to about 32 microseconds (see, for example, Japanese Patent Application Laid-Open No. H11-827).

However, in all the technologies disclosed in the above literatures, although a thick film is formed, the main constituent of the thick film is carbide. In other words, according to the above technologies, a dense thick film cannot be formed. Therefore, in the technologies disclosed in Japanese Patent Application Laid-Open No. H7-70761 and No. H7-197275, it is necessary to perform a remelting process using an electrode with less wear after forming a porous thick film.

For example, in the technology disclosed in Japanese Patent Application Laid-Open No. H7-197275, even when a coat that looks dense is successfully formed at first glance, the coat is porous when the coat is checked fully. In the technology disclosed in Japanese Patent Application Laid-Open No. H11-827, a thick film can also be formed when an electrode of hydride is used for forming a coat. However, the coat is dense only near a surface of a workpiece where a workpiece material and a coat material are melted. A part A of a coat formed thick as shown in FIG. 13 is porous.

In recent years, there is a demand for a dense and relatively thick coat (especially, a thick film with thickness of about 100 micrometers or more) in, for example, applications in which strength and lubricity under a high-temperature environment are required. Examples of a technology for forming a coat thick include welding for welding to deposit a material of a welding rod on a workpiece through electrical discharge between the workpiece and the welding rod (building-up welding) and thermal spraying for spraying a melted metallic material on a workpiece.

However, since both the methods require manual skilled operations, it is difficult to perform the operations on a production line, disadvantageously leading to an increase in cost. In particular, when the welding, which is a method in which heat enters a workpiece intensively, is applied to a thin material or a fragile material like a unidirectionally-solidified alloy such as a monocrystal alloy and a directionally-controlled alloy, weld crack is prone to occur, thereby disadvantageously reducing yield.

Therefore, it has been earnestly desired to establish a technology for forming a thick film having strength and lubricity under a high-temperature environment using an electrical-discharge surface-treatment technology that can perform operations on a production line while eliminating manual operations as much as possible and prevents intensive heat input in a workpiece.

The present invention has been devised in view of the circumstances and it is an object of the present invention to provide an electrical-discharge surface-treatment method for forming a dense thick film on a workpiece without using the technologies such as welding and thermal spraying.

SUMMARY OF THE INVENTION

It is an object of the present invention to at least solve the above problems.

In an electrical-discharge surface-treatment method according to an aspect of the present invention, a coat is formed on a surface of a workpiece using a pulse-like electrical discharge caused between an electrode and the workpiece. The electrode is molded with a metallic powder or a metallic compound powder having an average grain diameter in a range of 6 micrometers to 10 micrometers. The coat is formed with a material constituting the electrode or a substance that is generated by a reaction of the material due to the pulse-like electrical discharge. The coat is built up with a material containing metal as a main constituent under conditions of a width of a current pulse for the pulse-like electrical discharge in a range of 50 microseconds to 500 microseconds and a peak of the current pulse equal to or less than 30 amperes.

In an electrical-discharge surface-treatment method according to another aspect of the present invention, a coat is formed on a surface of a workpiece using a pulse-like electrical discharge caused between an electrode and the workpiece. The electrode is molded with a metallic powder or a metallic compound powder having an average grain diameter less than or equal to 3 micrometers. The coat is formed with a material constituting the electrode or a substance that is generated by a reaction of the material due to the pulse-like electrical discharge. The coat is built up with a material containing metal as a main constituent under conditions of a width of a current pulse for the pulse-like electrical discharge less than or equal to 70 microseconds and a peak of the current pulse equal to or less than 30 amperes.

In an electrical-discharge surface-treatment method according to still another aspect of the present invention, a coat is formed on a surface of a workpiece using a pulse-like electrical discharge caused between an electrode and the workpiece. The electrode is obtained by molding, or molding and heating a metallic powder or a metallic compound powder having an average grain diameter in a range of 2 micrometers to 6 micrometers. The coat is formed with a material constituting the electrode or a substance that is generated by a reaction of the material due to the pulse-like electrical discharge. The coat is built up with a material containing metal as a main constituent under conditions of a width of a current pulse for the pulse-like electrical discharge in a range of 5 microseconds to 100 microseconds and a peak of the current pulse 30 amperes or less.

The other objects, features, and advantages of the present invention are specifically set forth in or will become apparent from the following detailed description of the invention when read in conjunction with the accompanying drawings.

BRIEF DESCRIPTION OF THE DRAWINGS

FIG. 12 is a table of a result obtained by performing coat formation while changing an average grain diameter of an electrode material and a pulse width.

DETAILED DESCRIPTION

Exemplary embodiments of the present invention are explained in detail below with reference to the accompanying drawings. The present invention is not limited to the following description, and may be modified appropriately without departing from a scope of the present invention. Moreover, in the accompanying drawings, a scale of each member may differ for a purpose of easy understanding.

A concept for forming a dense thick film through electrical-discharge surface treatment according to the present invention is explained. In the conventional electrical-discharge surface treatment, an electrode material like titanium (Ti) is chemically reacted in oil through electrical discharge to form a hard carbide coat like titanium carbide (TiC). Therefore, the electrode used for the electrical-discharge surface treatment includes a large quantity of a material that is likely to form carbide.

As a result, for example, when the electrical-discharge surface treatment is applied to steel, as the electrical-discharge surface treatment proceeds, a material on a surface of a workpiece changes from steel to TiC, which is ceramics. Accordingly, characteristics like a thermal conductivity and a melting point change.

Through experiments performed by the inventors, it has been found that, in such a coat formation process, by adding a material less likely to be carbonized to constituents of the electrode material, it is possible to form a coat containing metal as a main constituent and form a thick coat. This is because addition of the material less likely to be carbonized to the electrode increase an amount of materials that remain on the coat keeping a metal state without becoming carbide. This has an important significance in forming a coat thick.

Figure 1:
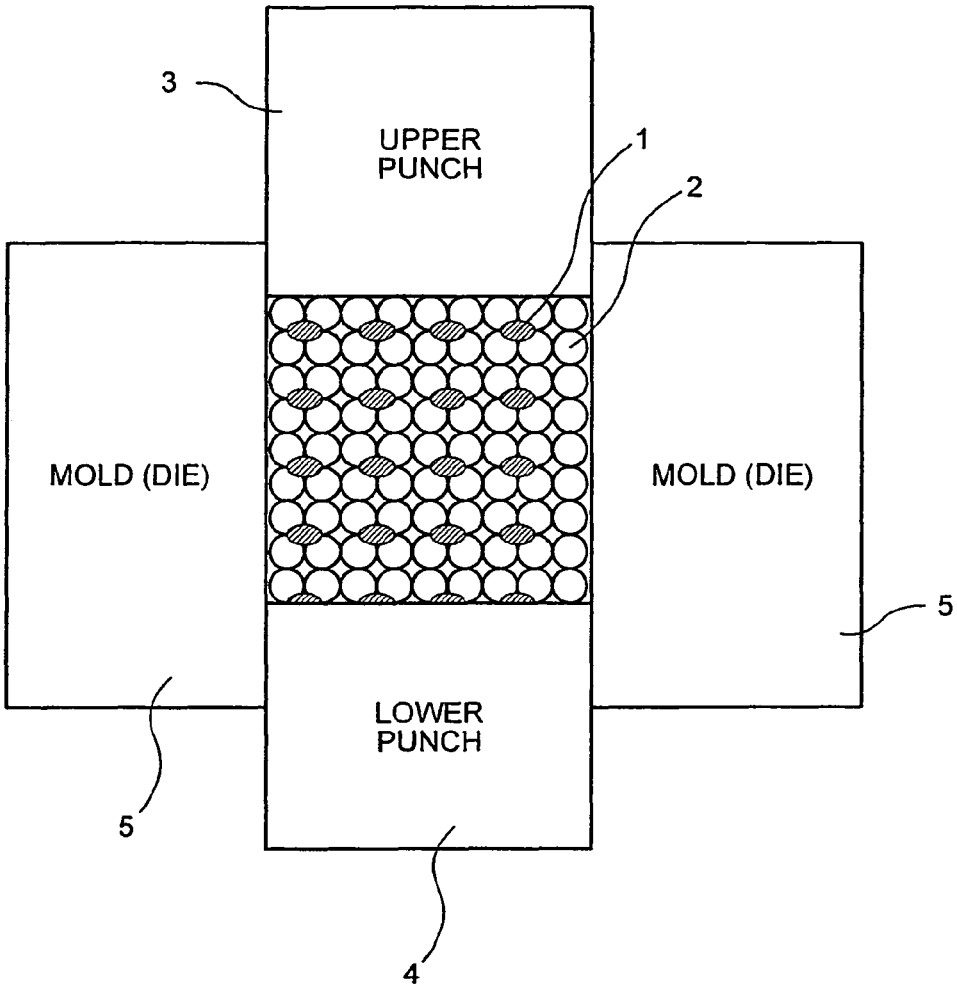
FIG. 1 is a schematic for illustrating a method of manufacturing an electrode for electrical-discharge surface treatment according to a first embodiment of the present invention.

A process for manufacturing an electrode for electrical-discharge surface treatment is explained with reference to FIG. 1. FIG. 1 is a schematic for illustrating a method of manufacturing an electrode for electrical-discharge surface treatment (hereinafter simply referred to as electrode) according to a first embodiment of the present invention. First, a chrome (Cr) powder 1, a material that is likely to form carbide, and a cobalt (Co) powder 2, a material that is less likely to form carbide, are mixed at a predetermined ratio (e.g., Cr: 25 weight %, Co: 75 weight %).

The mixed powder of the Cr powder 1 and the Co powder 2 is filled in a space surrounded by a mold upper punch 3, a mold lower punch 4, and mold dies 5. Then, the mixed powder is compression-molded by the upper punch 3 and the lower punch 4 to form a green compact of a predetermined shape. In the electrical-discharge surface treatment, this green compact is used as the electrode. Note that, in the first embodiment, the Cr powder 1 and the Co powder 2 have an average grain diameter of about 6 micrometers to 10 micrometers.

Wax like paraffin mixed in the mixed powder can facilitate transmission of a pressure to the inside of the mixed powder in the compression molding, and can improve moldability of the mixed powder. However, if a large amount of the wax remains in the electrode, an electric resistance of the electrode increases since the wax is an insulating substance, thereby degrading an electrical discharge property.

Thus, when wax is mixed in the mixed powder, it is preferable to remove the wax. Wax can be removed by putting the green compact electrode in a vacuum furnace and heating the green compact. In addition, by heating the green compact electrode, other effects are obtained. For example, it is possible to decrease an electric resistance of the green compact electrode and to increase strength of the green compact electrode. Therefore, even when wax is not mixed, heating after compression molding is meaningful.

Incidentally, the electrical-discharge surface treatment was performed using the electrode manufactured in the manner described above to form a coat. As pulse conditions for electrical discharge, a peak current value ie was set to 10 amperes, an electrical-discharge duration (an electrical-discharge pulse width) te was set to 64 microseconds, and a quiescent time was set to 128 microseconds. It was found that, in forming a dense thick film through the electrical-discharge surface treatment, a grain diameter of powder forming an electrode, a peak current value, and a pulse width have a strong relation. An outline of the relation is described below.

When the electrical-discharge surface treatment is performed using an electrode formed of a powder having a certain average grain diameter, it is possible to form a dense thick film when the electrical-discharge surface treatment is performed according to an electrical condition in an appropriate pulse width. However, when a pulse width is shorter than the appropriate range and when a pulse width is longer than the appropriate range, a formed coat is porous. Moreover, when a pulse width is short, although an electrode material deposits on a workpiece, the deposited electrode material has no strength to make the coat coarse.

It is considered that this is because, when a pulse width at the time of electrical-discharge surface treatment deviates from the appropriate pulse width and decreases, this makes electrical discharge energy insufficient and makes it impossible to melt the powder of the grain diameter, thereby making the coat porous. It is considered that this is also because, when a pulse width at the time of electrical-discharge surface treatment deviates from the appropriate pulse width and increases, conversely, this makes electrical discharge energy excessive to collapse the electrode significantly and supplies a large quantity of powder between poles, that is, between the electrode and the workpiece, thereby making it difficult to melt the powder entirely with an electrical discharge pulse.

Note that it has also been found through experiments performed by the inventors that a range of the appropriate pulse width changes to some extent according to a peak current value and increases as a grain diameter of powder of en electrode material increases.

When conditions of a certain pulse width are used as electrical discharge pulse conditions, it is possible to form a dense coat if the electrical-discharge surface treatment is performed using an electrode formed of powder in an appropriate grain diameter range corresponding to the pulse width. However, even if a condition of a certain pulse width is used, when the electrical-discharge surface treatment is performed using an electrode form of powder having a grain diameter larger than the appropriate range and when the electrical-discharge surface treatment is performed using an electrode formed of powder having a grain diameter smaller than the appropriate range, a formed coat is porous. When the electrical-discharge surface treatment is performed using an electrode formed of powder with a larger grain diameter, although an electrode material deposits on a workpiece, the electrode material has no strength to make the coat coarse.

Note that a relation between powder forming an electrode and a pulse width is affected by hardness of the electrode that is determined by heating temperature and the like of the electrode. The higher the hardness of the electrode is, the longer the pulse width appropriate for the electrical-discharge surface treatment becomes. The lower the hardness of the electrode is, the shorter the pulse width appropriate for the electrical-discharge surface treatment becomes. The correlation between a hardness of the electrode and the coat formation has been found through experiments performed by the inventors.

Concerning the peak current value of the electric pulse conditions, an extremely small peak current value causes pulse breakage of an electrical discharge and cannot melt powder of an electrode material. However, when the peak current value is equal to or lower than 30 amperes, it is possible to form a satisfactory coat if the appropriate pulse width is selected.

According to the experiments performed by the inventors, the peak current value of 2 amperes or more is required to prevent pulse breakage. On the other hand, when the peak current value exceeds 30 amperes, the electrode is damaged by a shock wave caused by energy of an electrical discharge pulse and collapses locally to supply a powder material to the workpiece excessively. As a result, the coat is also made porous. The peak current means a peak value of an electric current when the electric current is a rectangular-wave current. However, when a current value changes in one pulse, an average value in the pulse can be taken as the peak current.

According to the first embodiment, a dense thick film was successfully formed by using the electrode formed of the Cr powder 1 and the Co powder 2 having a grain diameter of about 6 micrometers to 10 micrometers and using an electrical discharge pulse having a pulse width of 5 microseconds to 500 microseconds. Thus, it is possible to build up a material densely and form a dense thick film having sufficient strength even under a high-temperature environment by performing working (electrical-discharge surface treatment) under working conditions (discharge pulse conditions) most suitable for a grain diameter of powder forming the electrode.

Among metallic substances, Cr is a material that forms oxide at high temperature and shows lubricity. Therefore, it is possible to form a thick film having lubricity under a high-temperature environment by performing the electrical-discharge surface treatment using an electrode containing Cr.

Therefore, it becomes possible to form a thick film having strength and lubricity under a high-temperature environment using a technology for electrical-discharge surface treatment that is capable of performing operations on a production line while eliminating manual operations as much as possible and prevents intensive heat input in a workpiece.

Note that, "dense" in "dense thick film" described here means a state in which a coat does not peel off easily even if the coat is filed (although, naturally, the coat is slightly removed by filing) and acquires a metal gloss through polishing.

In addition, the electrical-discharge surface treatment may be performed in a working fluid or in the air.

As a method of forming an electrode, a method of compression-molding powder through press has been explained. However, the method is not limited to compression molding by the press or the like as long as powder is molded in the electrode. As a method of forming an electrode, other than the compression molding by the press or the like, there are a method using slurry, a method of metal injection molding (MIM), a method of molding powder by thermal spraying or carrying nano-powder on a jet stream, and the like. The same holds true for embodiments to be described later.

The method using slurry is a method of molding powder by dispersing powder in a solvent, putting the solvent including the powder in a porous mold like a plaster mold to remove the solvent, and molding the powder. The MIM is a method of mixing a binder in powder and injecting the powder mixed with the binder into a heated die. The method of molding powder by thermal spraying is a method of spraying heated powder to mold powder in a partially bound state. Although the respective methods are different, the methods are identical in the object of molding powder. The powder can be used as the electrode as long as a binding state of powder becomes a predetermined state.

Figure 2:
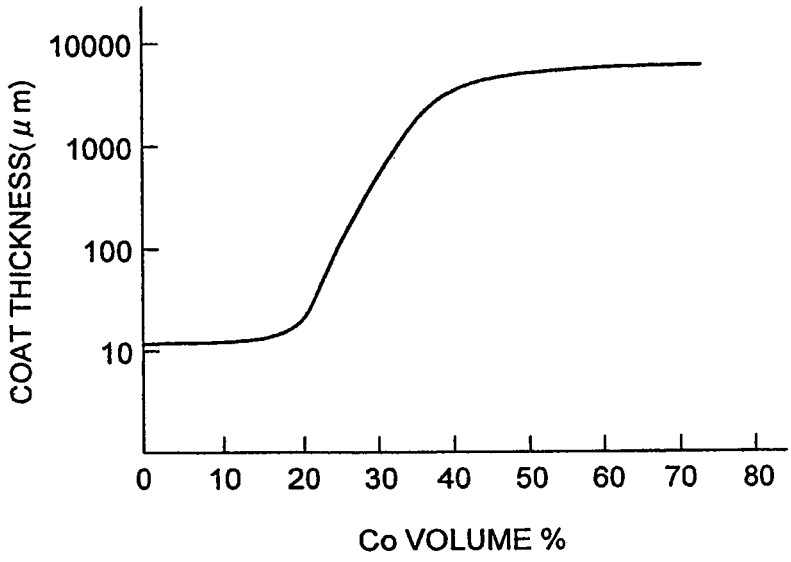
FIG. 2 is a characteristic chart of a state in which easiness to form a thick film changes as a content of Co in an electrode is changed.

Next, a second embodiment of the present invention is explained with reference to the drawings. FIG. 2 illustrates a state in which, when electrical-discharge surface treatment is performed using an electrode manufactured by compression-molding and heating a mixed powder of $Cr_3C_2$ (chromium carbide: grain diameter 3 micrometers) and Co (cobalt: grain diameter 2 micrometers), easiness of formation of a thick film changes by changing a content of Co.

The base material of the electrode is $Cr_3C_2$. A content of the Co, which is a material that is less likely to form carbide, is 40 volume % or more and a heating temperature after the compression molding of the mixed powder is about 900° C.

Figure 3A:
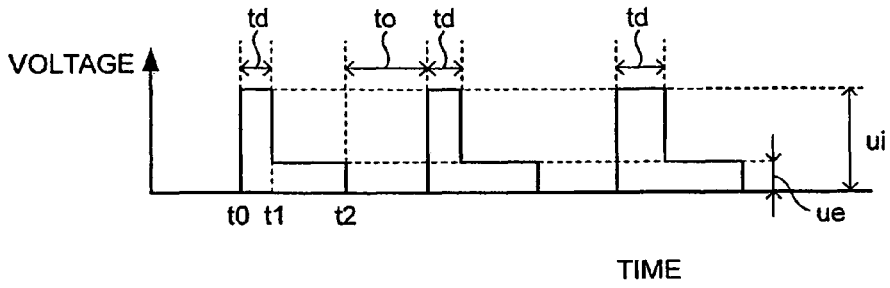
FIG. 3A is a characteristic chart of a voltage waveform when electrical-discharge surface treatment is performed.
Figure 3B:
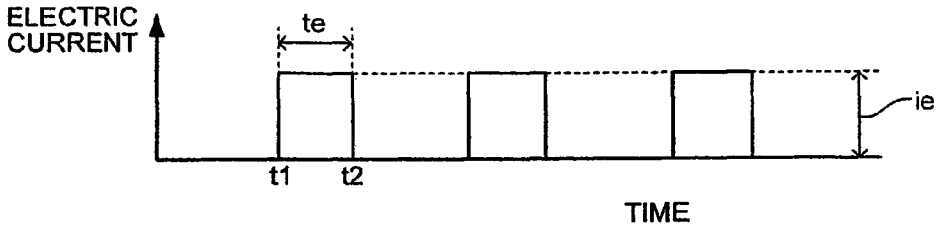
FIG. 3B is a characteristic chart of a current waveform corresponding to the voltage waveform in FIG. 3A.

The electrical-discharge surface treatment was performed using a green compact electrode (having an area of 15 millimeters×15 millimeters) manufactured under such conditions to form a coat. FIGS. 3A and 3B illustrates examples of electrical discharge pulse conditions in performing the electrical-discharge surface treatment. FIG. 3A illustrates a voltage waveform applied between an electrode and a workpiece at the time of electrical discharge and FIG. 3B illustrates a current waveform of an electric current flowing at the time of electrical discharge. As shown in FIG. 3A, a no-load voltage ui is applied between both poles at time t0. An electric current starts flowing between both the poles at time t1 after elapse of discharge delay time td and electrical discharge starts. A voltage at this point is a discharge voltage ue and an electric current flowing at this point is a peak current value ie. Then, when the supply of a voltage between both the poles is stopped at time t2, the electric current stops flowing.

The time period between t1 and t2 indicates a pulse width te. A voltage waveform between time t0 and t2 is applied between both the poles repeatedly at intervals of quiescent time to. In other words, a pulse-like voltage as shown in FIG. 3A is applied between the electrode and the workpiece.

In the second embodiment, as the electrical discharge pulse conditions, the peak current value ie is set to 10 amperes, the electrical-discharge duration (an electrical-discharge pulse width) te is set to 64 microseconds, and the quiescent time to is set to 128 microseconds. Note that a treatment time is 15 minutes.

As shown in FIG. 2, when the content of Co in the electrode is 0%, that is, when the content of $Cr_3C_2$ in the electrode is 100%, about 10 micrometers is a limit of thickness of a coat that can be formed. The coat is made of a material containing $Cr_3C_2$ as a main constituent and a base material.

Figure 4:
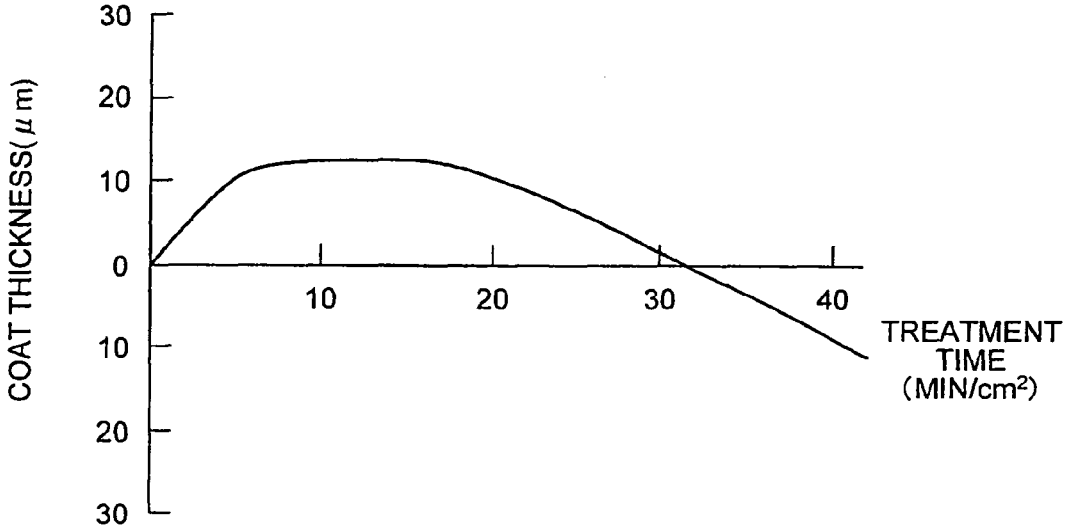
FIG. 4 is a characteristic chart of a formation of a coat with respect to treatment time when an electrode contains no material that is less likely to form carbide.

FIG. 4 illustrates a formation of a coat with respect to treatment time when the electrode contains no material that is less likely to form carbide. As shown in FIG. 4, in an initial period of the electrical-discharge surface treatment, the coat grows as time passes and thickness of the coat saturates in a certain time (about 5 minutes/$cm^2$).

Thereafter, the coat does not grow for a while. When the electrical-discharge surface treatment is continued for more than a certain time (about 20 minutes/$cm^2$), the thickness of the coat starts decreasing. Finally, the thickness changes to minus, that is, the workpiece is dug. However, the coat is still present even in the dug state and the thickness thereof is about 10 micrometers. This is almost the same as thickness of the coat formed in an appropriate time.

Referring back to FIG. 2, it has been found that the coat can be formed thick as the content of Co, which is less likely to be carbonized, in the electrode is increased. Specifically, when the content of Co in the electrode exceeds 20 volume %, the thickness of the formed coat starts increasing, and when the content exceeds 40 volume %, the thickness stabilizes, making it easy to form a thick film. By increasing a quantity of materials remaining in the coat as metal, it is possible to form the coat containing a metal component, which has not changed to carbide, making it easy to form a thick film stably. Co is considered to play a role of a binder in the coat.

Note that volume % in this context means a ratio of values obtained by dividing weights of mixed powders by densities of the respective materials and indicates a rate of a volume occupied by a material in a volume of materials of all powders.

For example, in the case of volume % of a Co powder, "volume % of Co powder=volume of Co powder/(volume of $Cr_3C_2$ powder+volume of Co powder)×100".

A volume of powder is not an apparent volume (a volume as powder) but a substantial volume of the powder material. For example, "volume of Co powder=weight of Co powder/density of Co powder".

It is preferable that a rate of the material, which is less likely to be carbonized, contained in the electrode is equal to or higher than 40 volume %. As shown in FIG. 2, when the peak current value ie is set to 10A, the electrical-discharge duration (the electrical-discharge pulse width) te is set to 64 microseconds, and the quiescent time to is set to 128 microseconds as the electrical discharge pulse conditions, it is possible to form a coat with thickness of about 10 micrometers even if the rate of the material, which is less likely to be carbonized, is equal to or lower than 40 volume %. According to the experiments performed by the inventors, the peak current value of 2 amperes or more is required to prevent pulse breakage. On the other hand, when the peak current value exceeds 30 amperes, the electrode is damaged by a shock wave caused by energy of an electrical discharge pulse and collapses locally to supply a powder material to the workpiece excessively. As a result, the coat is also made porous. As for the pulse width, a dense thick film was successfully formed when the pulse width is set to 70 microseconds or less. However, pulse conditions have to be set appropriately to form a dense thick film. For example, although it is possible to build up a material densely even if the rate of the material, which is less likely to be carbonized, contained in the electrode is about 30 volume %, a range of the conditions is extremely narrow.

For example, when an excessively large quantity of a material, which forms carbide, is contained in the electrode, when electric conditions are not appropriate, or when a state of the electrode is bad, although build-up of the material is formed, it is easily removed or a metal gloss is not acquired even if the film is polished. However, in the second embodiment, the working (electrical-discharge surface treatment) is performed under the working conditions (electrical discharge pulse conditions) most suitable for a grain diameter of powder forming the electrode. This makes it possible to build up a material densely because metal in the formed coat functions as binding and form a coat having sufficient strength.

Figure 5:
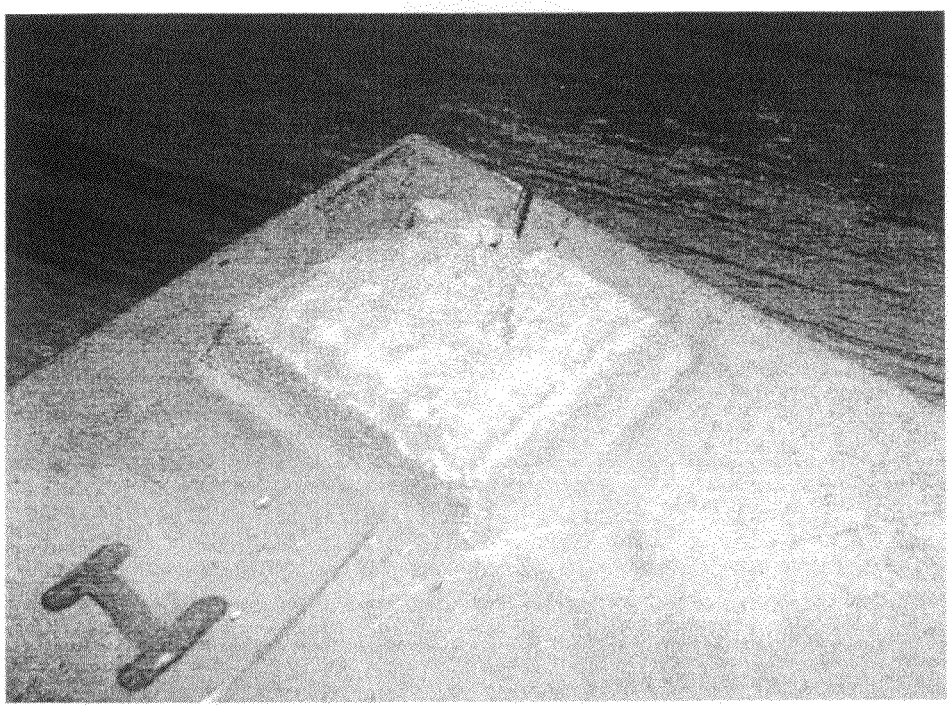
FIG. 5 is a photograph of a coat that is formed when the electrode contains 70 volume % of Co.

A photograph of a coat, which is formed when a content of Co in an electrode is 70 volume %, is shown in FIG. 5. In the photograph shown in FIG. 5, a thick film having a thickness of about 2 millimeters is formed. This coat is formed with treatment time of 15 minutes under the conditions described above. However, it is possible to form a thicker coat by increasing the treatment time.

Thus, the electrode containing 40 volume % or more of the material, which is less likely to be carbonized, such as Co in the electrode is used and the working (electrical-discharge surface treatment) is performed under the working conditions (electrical discharge pulse conditions) most suitable for a grain diameter of powder forming the electrode. Consequently, it is possible to form a coat, which is stably dense and thick, on a surface of a workpiece by the electrical-discharge surface treatment.

Figure 6:
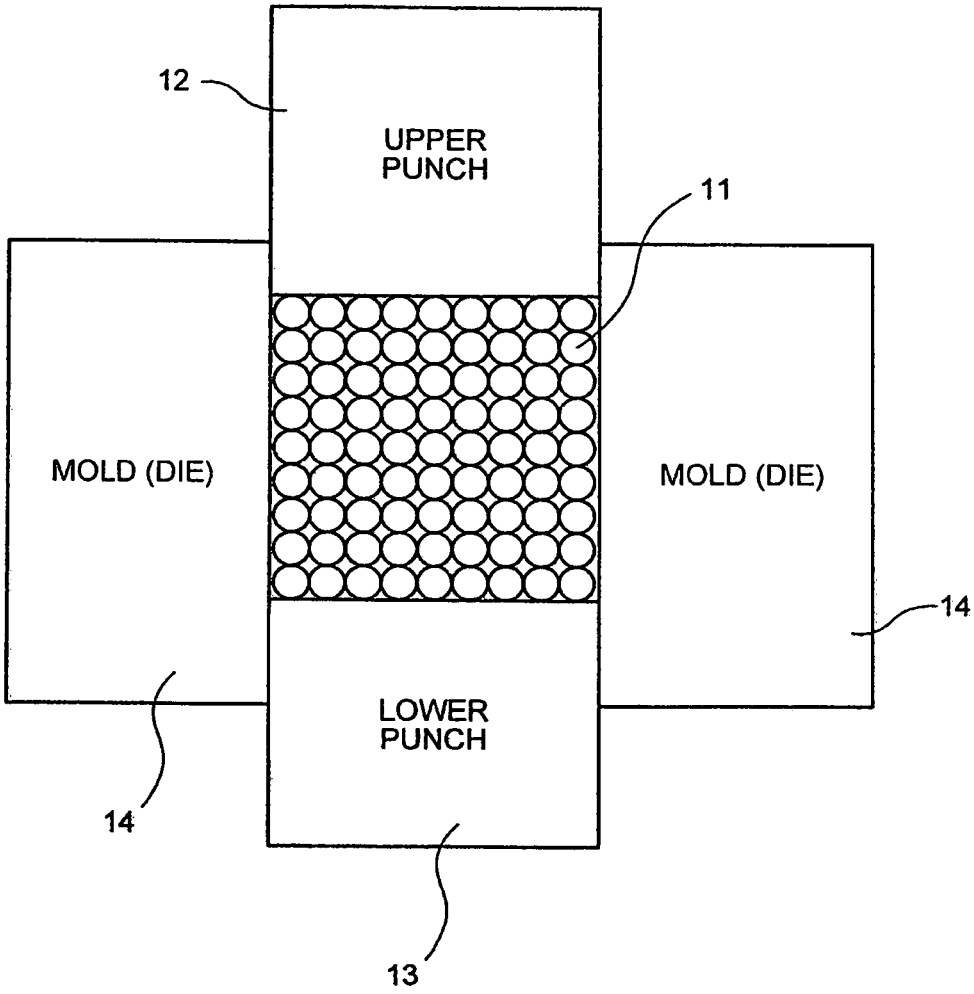
FIG. 6 is a schematic for illustrating a method of manufacturing an electrode according to a third embodiment of the present invention.

Next, a third embodiment of the present invention will be explained with reference to the drawings. FIG. 6 is a schematic for illustrating a method of manufacturing an electrode according to the third embodiment.

A Co powder 11 having a grain diameter of about 1 micrometer is filled in a space surrounded by a mold upper punch 12, a mold lower punch 13, and mold dies 14. The Co powder 11 is compression-molded by the upper punch 12 and the lower punch 13 to form a green compact of a predetermined shape. In the electrical-discharge surface treatment, this green compact is used as the electrode.

A predetermined press pressure is applied to the powder to harden the powder and change the powder to a green compact. However, the green compact cannot be used as the electrode as it is since it has a high electric resistance. The electric resistance of the electrode can be roughly estimated, for example, as shown in FIG. 7A, by nipping an electrode 21 with metallic plates 22 and bringing electrode terminals 24 of a tester 23 into contact with the metallic plates 22.

Figure 7A:
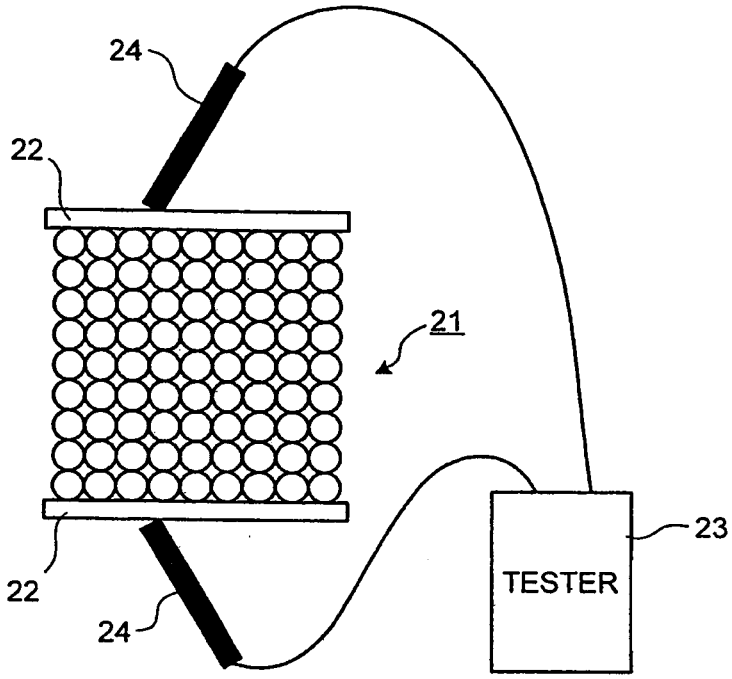
FIG. 7A is a schematic for illustrating a method of measuring an electric resistance of the electrode conveniently.
Figure 7B:
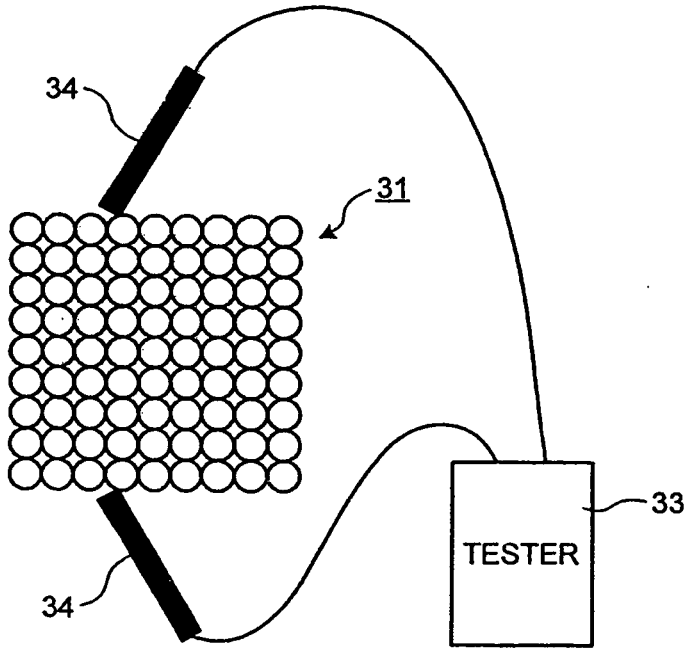
FIG. 7B is a schematic for illustrating a method of measuring the electric resistance of the electrode more conveniently.

Alternatively, as shown in FIG. 7B, the electric resistance can be estimated by a simpler method of bringing electrode terminals 34 of a tester 33 into contact with both ends of an electrode 31.

In the third embodiment, Co used as the electrode material has a melting point exceeding 1000° C. However, the researches of the inventor made it clear that, when an electrode was observed fully, a part of the material (Co) melted even at temperature of about 200° C. to lower an electric resistance of the electrode.

Figure 8:
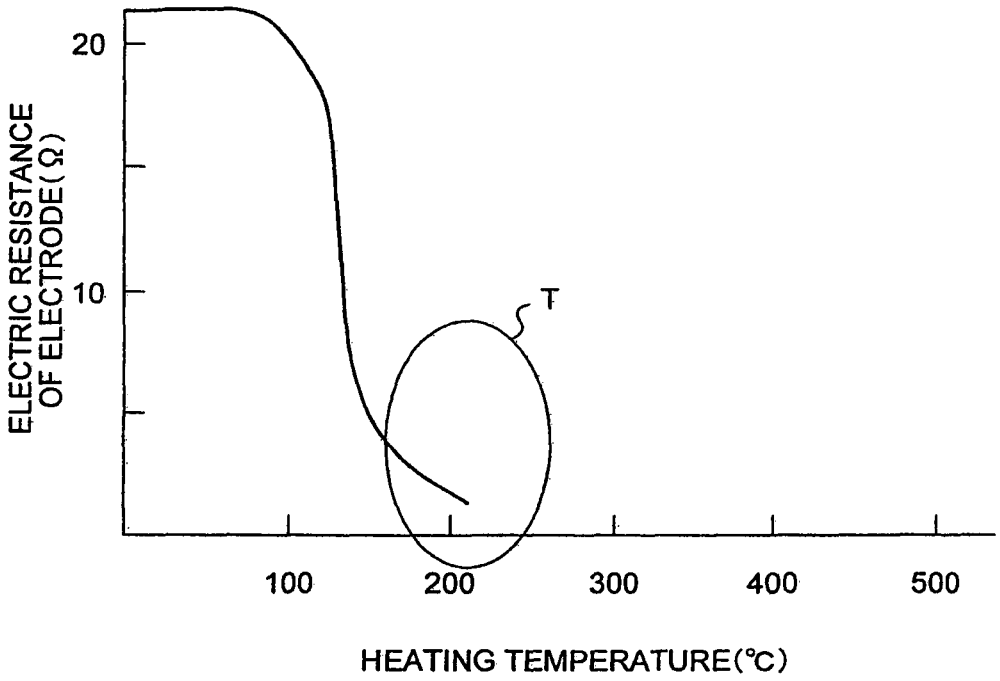
FIG. 8 is a characteristic chart of a relation between a heating temperature and an electric resistance.

When the Co powder having a grain diameter of about 1 micrometer shown in FIG. 6 was molded into a green compact having a diameter of about 18 millimeters and a length of about 30 millimeters, an electric resistance measured by the measuring method shown in FIG. 7A indicated several ohms to several tens ohms at the point when the powder was compression-molded. FIG. 8 illustrates a relation between an electric resistance and a heating temperature when the green compact was heated in a predetermined time in a vacuum furnace and then held at a predetermined temperature for one hour to two hours.

When the heating temperature for the green compact was low (100° C. or less), the electric resistance of the green compact hardly fell. However, when the green compact was heated in a temperature range T of about 200° C. shown in FIG. 8, the electric resistance of the green compact fell to almost 0 ohm. For the green compact formed of the material described above, temperature of about 200° C. to 250° C. was optimum. When the heating temperature exceeded 300° C., it was difficult to form a thick film since the electrode becomes too hard and therefore an amount of the electrode material supplied between poles by electrical discharge decreased.

Figure 9:
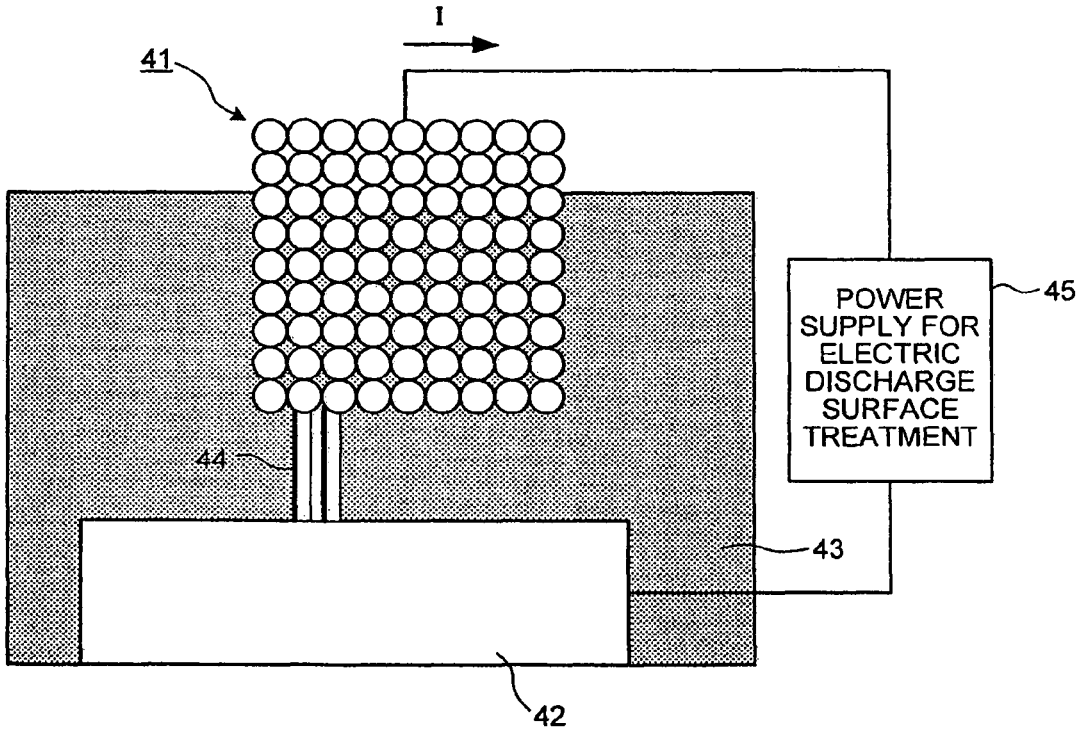
FIG. 9 is a schematic of a state in which electrical-discharge surface treatment is performed in working fluid.
Figure 10:
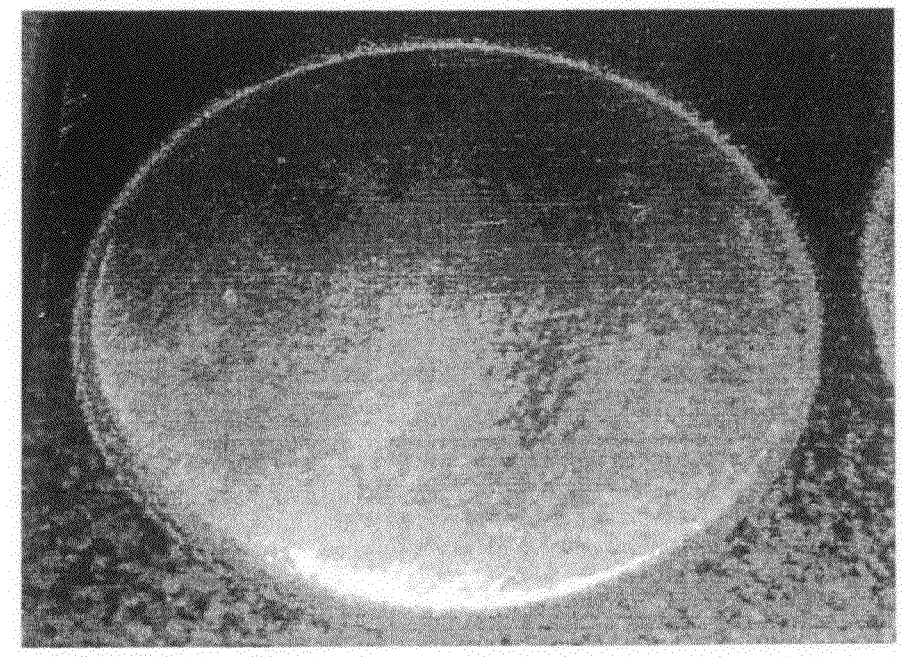
FIG. 10 is a photograph of a formed coat.

FIG. 9 illustrates a state in which electrical-discharge surface treatment is performed by an electrical-discharge surface-treatment apparatus using the electrode manufactured in the process described above. In the state shown in FIG. 9, a pulse-like electrical discharge occurs. A photograph of a coat formed by the electrical-discharge surface treatment is shown in FIG. 10. In the photograph shown in FIG. 10, a thick film having thickness of about 1 millimeter is formed.

The electrical-discharge surface treatment apparatus shown in FIG. 9 includes an electrode for electrical-discharge surface treatment 41 (hereinafter simply referred to as electrode 41), a working fluid 43, and a power supply for electrical-discharge surface treatment 45. The electrode 41 is the electrode described above and made of a green compact obtained by compression-molding and heating the Co powder 11 having a grain diameter of about 1 micrometer. The power supply for electrical-discharge surface treatment 45 applies a voltage between the electrode 41 and a workpiece 42 to generate a pulse-like electrical discharge (an arc column) 44. A servo mechanism for controlling an interpole distance (that is, a distance between the electrode 41 and the workpiece 42), a reservoir tank for storing the working fluid 43, and the like are not shown in FIG. 9, because these components are not directly related to the present invention.

To form a coat on a surface of a workpiece using the electrical-discharge surface treatment apparatus, the electrode 41 and the workpiece 42 are arranged to be opposed to each other in the working fluid 43. In the working fluid 43, a pulse-like electrical discharge is caused between the electrode 41 and the workpiece 42 using the power supply for electrical-discharge surface treatment 45. Specifically, a voltage is applied between the electrode 41 and the workpiece 42 to cause electrical discharge. As shown in FIG. 9, the ark column 44 of electrical discharge is caused between the electrode 41 and the workpiece 42.

A coat is formed on a surface of the workpiece by energy of the electrical discharge caused between the electrode 41 and the workpiece 42. Alternatively, a coat of a substance, which is generated by a reaction of an electrode material due to the electrical discharge energy, is formed on the surface of the workpiece. The electrode 41 has a negative polarity and the workpiece 42 has a positive polarity. An electric current I at the time of electrical discharge flows in a direction from the electrode 41 to the power supply for electrical-discharge surface treatment 45.

As conditions for an electrical discharge pulse in the electrical-discharge surface treatment, a peak current value is set to 10 amperes, an electrical-discharge duration (an electrical-discharge pulse width) is set to 8 microseconds, and a quiescent time is set to 16 microseconds. In the third embodiment, a coat having thickness of about 1 millimeter is formed by treatment for five minutes.

In the first embodiment described above, since the electrode made of the mixed powder of the Cr powder 1 and the Co powder having a grain diameter of about 6 micrometers to 10 micrometers is used, a formed thick film is distorted and irregular. In the first embodiment, a dense coat is formed using an electrical discharge pulse having a pulse width of 50 microseconds to 500 microseconds. However, it is possible to form a dense coat by reducing a grain diameter of powder to reduce the pulse width.

This is because, when a grain diameter of powder of an electrode material forming an electrode is reduced, it is possible to melt the powder of the electrode material sufficiently even under conditions that a pulse width is small and energy is small and form a coat by stacking craters with small electrical discharge. Thus, it is possible to form a dense coat.

In the third embodiment, when the grain diameter of the Co powder is about 1 micrometer, a dense coat was successfully formed with a pulse width of 50 microseconds or less. When the pulse width exceeds 50 microseconds, a coat is made porous because an electrode is collapsed significantly because of electrical discharge.

According to the experiments performed by the inventors, the peak current value of 2 amperes or more is required to prevent pulse breakage. On the other hand, when the peak current value exceeds 30 amperes, the electrode is damaged by a shock wave caused by energy of an electrical discharge pulse and collapses locally to supply a powder material to the workpiece excessively. As a result, the coat is also made porous.

Harness of an electrode is explained. When the grain diameter was small and the electrode was hard, hardness of the electrode was measured using Rockwell hardness or the like. When a grain diameter was large and the electrode is soft, hardness of the electrode was measured using the pencil scratch test for film coating specified in Japanese Industrial Standard (JIS) K 5600-5-4. Although the standard is originally used for evaluation of a coated film, it has been found that the standard is suitable for evaluation of a material with low hardness. This pencil scratch test for film coating and other hardness evaluation methods are convertible to each other. Therefore, the other methods may be used as indices.

When the grain diameter is about 5 to 6 micrometers, a state of a coat is the best and a dense thick film can be formed when hardness of the electrode is about 4B to 7B. However, even if the hardness deviates from this range slightly, a thick film can be still formed. When the hardness is increased, it is possible to form a thick film until the electrode becomes as hard as B. When the hardness is decreased, it is possible to form a thick film until the electrode becomes as soft as 8B.

However, formation speed of a coat tends to fall as hardness of an electrode increases. With the hardness of about B, it is relatively difficult to form a thick film. When the hardness of the electrode further increases, a thick film cannot be formed. As the hardness of the electrode even more increases, a workpiece is removed undesirably.

When hardness of an electrode is decreased, it is possible to form a thick film until the electrode becomes as soft as 8B. However, an analysis of a construction of a formed thick film has revealed that holes gradually increase in the thick film. When the electrode becomes softer than about 9B, an electrode constituent deposits on the workpiece while not melting sufficiently. Note that this relation between hardness of an electrode and a state of a coat also changes slightly depending on electrical discharge pulse conditions. When appropriate electrical discharge pulse conditions are used, it is also possible to expand a range of hardness of an electrode in which a relatively satisfactory coat can be formed.

In the third embodiment described above, since the powder having a grain diameter of about 5 micrometers was used, the hardness of an electrode described above was an optimum value. However, the optimum value is significantly influenced by a grain diameter of powder forming the electrode. A reason for this is as described below. Binding strength of powder forming the electrode determines whether an electrode material is discharged from the electrode by electrical discharge. When the binding strength is high, the powder is discharged less easily by energy of electrical discharge. On the other hand, when the binding strength is low, the powder is discharged easily by energy of electrical discharge.

When the grain diameter of powder forming the electrode is large, the number of points where powders join in the electrode decreases to make electrode strength low. On the other hand, when the gain diameter of powder forming the electrode is small, the number of points where powders join in the electrode increases to make electrode strength high.

As explained above, in the third embodiment, it is possible to build up a material densely and form a coat having sufficient strength by performing working under working conditions most suitable for a grain diameter of powder forming an electrode and hardness of the electrode.

When powder of Co, which is a material that is less likely to form carbon, is used as an electrode material, it is possible to form a thick coat by adopting conditions that an electrical-discharge pulse width is 50 micrometers or less and a peak current value is about 10 amperes. In addition, through experiments performed by the inventors, it has been found that it is possible to form a thick coat (of only Mo) with an electrode containing molybdenum (Mo) having a grain diameter of 0.7 micrometers.

Since Mo is a material that is likely to form carbide, it was effective for forming a dense coat to use a condition that an electrical-discharge pulse width was relatively long at 60 microseconds or more and 70 micrometers or less and supply an electrode material, which was not melted completely by an electrode discharge pulse, to a workpiece. In the case of a material that is likely to form carbide, such as Mo, when the material is supplied to a workpiece in a state in which the material is completely melted by an electrical discharge pulse, the material supplied to the workpiece is carbonized to be molybdenum carbide to make it difficult to form a thick film. However, it is possible to form a dense coat by adjusting an electrical-discharge pulse width and supply the material, which is not completely melted by an electrical discharge pulse, to a workpiece as described above. The same result was obtained when tungsten (W), niobium (Nb), or chrome (Cr) were used.

Figure 11:
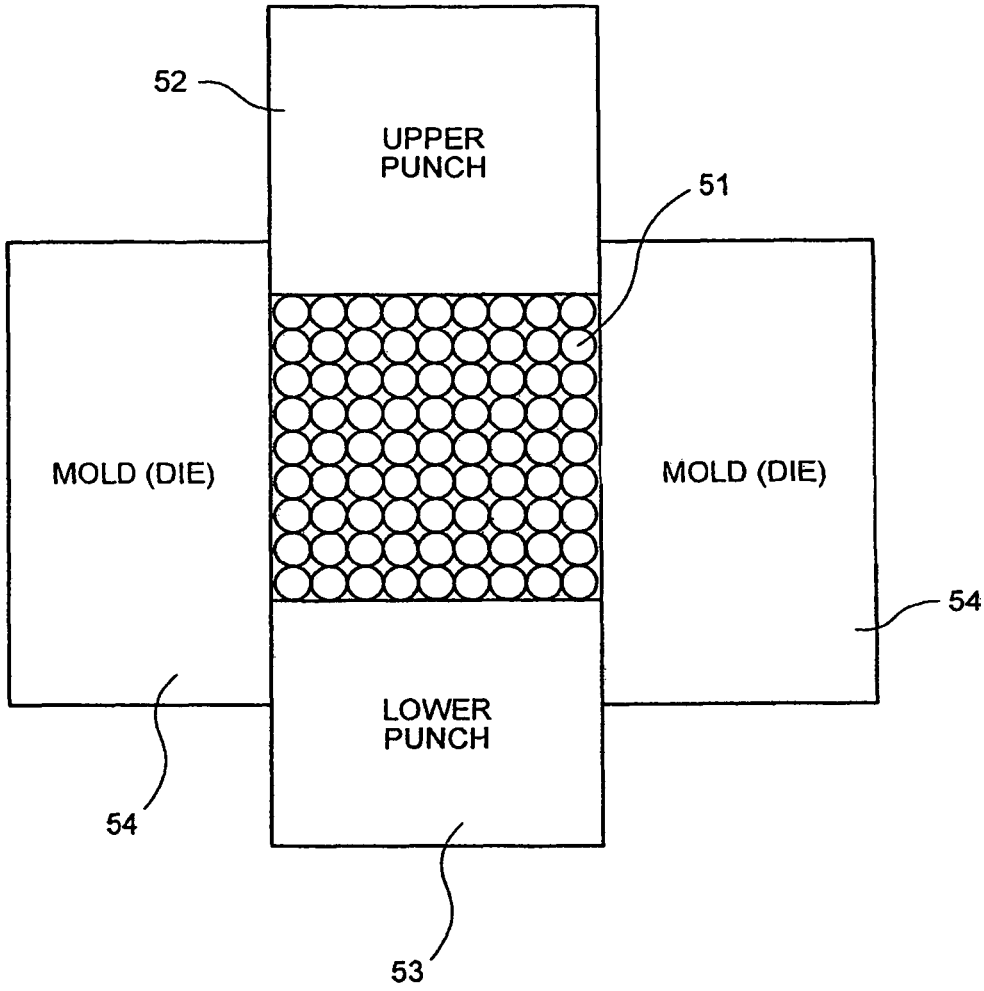
FIG. 11 is a schematic for illustrating a method of manufacturing an electrode.
Figure 13:
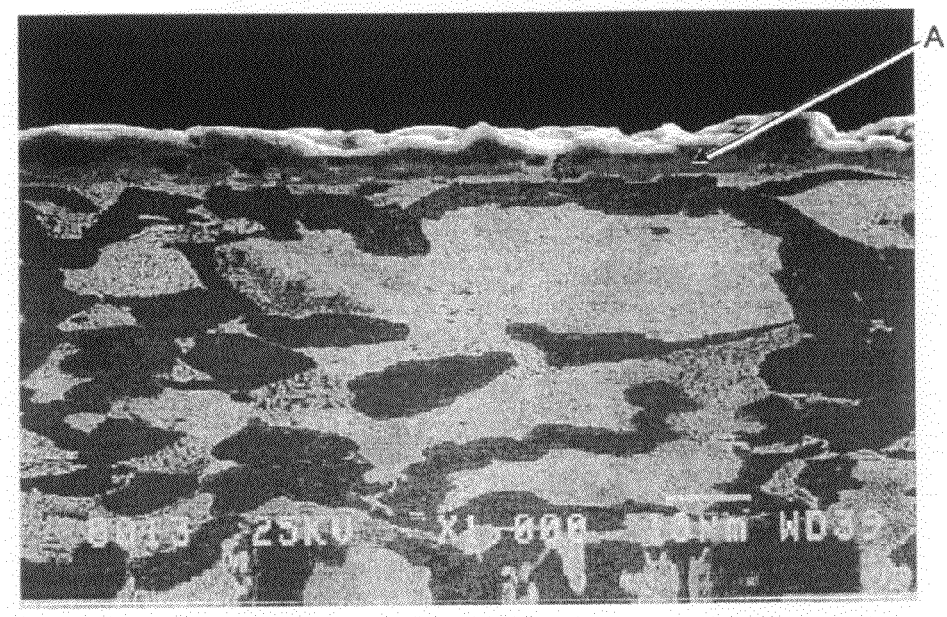
FIG. 13 is a microscopic photograph of a coat formed by the conventional electrode.

Next, a fourth embodiment of the present invention is explained with reference to the drawings. FIG. 11 is a schematic for illustrating a method of manufacturing an electrode according to the fourth embodiment. A Co alloy powder 51 having a grain diameter of about 1 micrometer is filled in a space surrounded by a mold upper punch 52, a mold lower punch 53, and mold dies 54. The Co alloy powder 51 is compression-molded by the upper punch 52 and the lower punch 53 to form a green compact of a predetermined shape. In the electrical-discharge surface treatment, this green compact is used as the electrode.

Note that, in the fourth embodiment, an alloy of a Co base containing chrome (Cr), nickel (Ni), tungsten (W), and the like (Cr: 20 weight %, Ni: 10 weight %, W: 15 weight %, Co: the rest) is used as the Co alloy powder 51. An average grain diameter of the alloy is about 1 micrometer.

However, the green compact cannot be used as the electrode as it is since it has a high electric resistance.

Furthermore, it is difficult to harden the Co alloy powder 51 by press because the Co alloy powder 51 is a hard alloy. Therefore, it is necessary to add wax such as paraffin to the Co alloy powder 51 for improvement of moldability. However, electric conductivity at the time of electrical-discharge surface treatment falls as a residual amount of the wax in an electrode increases. Therefore, it is preferable to remove the wax in a later process.

Thus, to remove the wax and decrease the electric resistance of the electrode, the green compact is put in a vacuum furnace. After temperature rise for a predetermined time, the green compact is kept at a predetermined temperature for one hour to two hours.

When an electrode was molded using the Co powder having a grain diameter of 1 micrometer as described in the third embodiment, 200° C. to 250° C. was optimum as the heating temperature. On the other hand, when an electrode was molded using the Co alloy powder 51, an optimum heating temperature at which the electric resistance fell was high at 800° C. to 900° C. However, if the electrode is heated to 800° C. at a time, the wax is carbonized to remain in the electrode as impurities. Therefore, it is necessary to remove the wax at low temperature once.

When the heating temperature was 200° C. and 300° C., the electrode according to the third embodiment was in a coarse state, which made it impossible to form a coat. When the heating temperature was 1000° C., hardness of the electrode increased, which made it impossible to form a coat.

Next, conditions for making it possible to form a dense coat were checked with an average grain diameter of the Co alloy powder 51 as a parameter. A peak current value was set to 10 amperes and a pulse width was changed variously. Electrodes used in performing electrical-discharge surface treatment were molded to "appropriate hardness", which means that the electrodes have conditions for making it possible to form a dense coat.

It is difficult to form a dense thick film unless hardness of an electrode is not appropriate. When hardness of the electrode is too high, a thick film cannot be formed. When hardness of the electrode is too low, although a built-up film can be formed, the film is made porous and not dense.

Conditions for making it possible to form a dense coat with an average grain diameter of the Co alloy powder 51 as a parameter is shown in FIG. 12. There are parts where a range in which a coat is formed dense and a range in which a coat is not formed dense (for example, the coat is porous) overlap. This is because the ranges fluctuate to some extent depending on hardness of an electrode or the like.

Optimum hardness of an electrode varies depending on a grain diameter of powder of an electrode material. For example, as for a hard electrode made of an electrode material having an average grain diameter of 2 micrometers to 6 micrometers, it is possible to form a dense coat even at a pulse width of about 10 microseconds. On the other hand, when hardness of an electrode is rather low, a coat is made porous even at a pulse width of about 40 microseconds. Therefore, the comparison shown in FIG. 12 was performed at hardness at which a dense coat can be formed for each grain diameter.

A condition of a pulse width for making a coat dense differs depending on a condition of hardness of an electrode or the like. However, there are conditions for making it possible to form a dense thick film in the ranges shown in FIG. 12.

According to the experiments performed by the inventors, the peak current value of 2 amperes or more is required to prevent pulse breakage. On the other hand, when the peak current value exceeds 30 amperes, the electrode is damaged by a shock wave caused by energy of an electrical discharge pulse and collapses locally to supply a powder material to the workpiece excessively. As a result, the coat is also made porous.

In the fourth embodiment, the material obtained by pulverizing the alloy with an alloy ratio of "Cr: 20 weight %, Ni: 10 weight %, W: 15 weight %, Co: the rest" was used. However, an alloy to be pulverized may be an alloy with other formulations. For example, it is possible to use an alloy with an alloy ratio of "Cr: 25 weight %, Ni: 10 weight %, W: 7 weight %, Co: the rest". It is also possible to use alloys with the following alloy ratios: "molybdenum (Mo): 28 weight %, chrome (Cr): 17 weight %, silicon (Si): 3 weight %, cobalt (Co): the rest", "chrome (Cr): 15 weight %, iron (Fe): 8 weight %, nickel (Ni): the rest", "chrome (Cr): 21 weight %, molybdenum (Mo): 9 weight %, tantalum (Ta): 4 weight %, nickel (Ni): the rest", and "chrome (Cr): 19 weight %, nickel (Ni): 53 weight %, molybdenum (Mo): 3 weight %, columbium (Cb)+ tantalum (Ta): 5 weight %, titanium (Ti): 0.8 weight %, aluminum (Al): 0.6 weight %, iron (Fe): the rest". However, if an alloy ratio of an alloy differs, characteristics such as hardness of materials differ. Thus, slight differences are caused in moldability of an electrode and a state of a coat.

In the fourth embodiment, the Co alloy powder 51 containing Co as a main constituent is used as the electrode material. This is because, as described above, the Co alloy powder is effective in increasing thickness of a coat. In electrical-discharge surface treatment using an electrode containing only a material that is likely to form carbide, a formed coat is formed of a carbide ceramics. Thus, thermal conductivity is deteriorated and removal of the coat tends to advance through electrical discharge.

Therefore, Co, which is a material that is less likely to form carbide, is mixed as a constituent of the electrode material. This prevents thermal conductivity of the coat from being deteriorated and makes it possible to increase thickness of the coat. As materials having the same effect as Co, there are Ni, Fe, and the like.

In the fourth embodiment, a peak current value of conditions for electrical discharge is set to 10 amperes. However, it is possible to obtain a dense thick film substantially in the same range if the peak current value is about 30 amperes or less. When the peak current value increases to 30 amperes or more, problems occur. For example, an electrode is collapsed unnecessarily severely by an impact of electrical discharge or hardness of the electrode increases because heat input increases. The peak current means a peak value of an electric current when the electric current is a rectangular-wave current. However, when a current value changes in one pulse, an average value in the pulse can be taken as the peak current.

According to the fourth embodiment, it is possible to build up a material densely and form a dense thick film having sufficient strength by performing working (electrical-discharge surface treatment) under working conditions (discharge pulse conditions) most suitable for a grain diameter of powder forming an electrode and hardness of the electrode.

As described above, it has been found by researches performed by the inventors that, in forming a dense thick film through the electrical-discharge surface treatment, there is a strong correlation among a grain diameter of powder of an electrode material forming an electrode, a peak current value, and a pulse width.

Therefore, according to the present invention, it is possible to form a dense thick film by performing the electrical-discharge surface treatment under appropriate electrical-discharge surface treatment conditions corresponding to an average grain diameter of an electrode material forming an electrode for the electrical-discharge surface treatment.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. An electrical-discharge surface-treatment method for forming a coat on a surface of a workpiece using a pulse electrical discharge between an electrode and the workpiece, the method comprising:

forming the coat with a material constituting the electrode or a substance that is generated by a reaction of the material due to the pulse electrical discharge, wherein:

the electrode is formed by compression-molding and heating a powder comprising a metallic powder or a metallic compound powder, the electrode is formed by the powder and a base powder, each having an average grain diameter of 3 micrometers or less, the powder is 40% volume or more of a metallic material, the coat contains the metallic powder or the metallic compound powder as a result of the reaction generated under conditions of a width of a current pulse for the pulse electrical discharge less than or equal to 70 microseconds and a peak of the current pulse in a range of 2 amperes to 30 amperes, and the metallic material is as likely or less likely to be carbonized than at least one of Co, Fe, and Ni.

2. The electrical-discharge surface-treatment method according to claim 1, wherein the electrode comprises:

the metallic material comprising one of Co, Fe, and Ni, and another metal that is harder than the metallic material.

3. The electrical-discharge surface-treatment method according to claim 1, wherein the metallic powder and the metallic compound powder have any one of compositions of 20 weight % of chrome, 10 weight % of nickel, 15 weight % of tungsten, and rest of cobalt; 25 weight % of chrome, 10 weight % of nickel, 7 weight % of tungsten, and rest of cobalt;

28 weight % of molybdenum, 17 weight % of chrome, 3 weight % of silicon, and rest of cobalt;

15 weight % of chrome, 8 weight % of iron, and rest of nickel;

21 weight % of chrome, 9 weight % of molybdenum, 4 weight % of tantalum, and rest of nickel; and 19 weight % of chrome, 53 weight % of nickel, 3 weight % of molybdenum, 5 weight % of columbium+tantalum, 0.8 weight % of titanium, 0.6 weight % of aluminum, and rest of iron.

4. An electrical-discharge surface-treatment method for forming a coat on a surface of a workpiece using a pulse electrical discharge between an electrode and the workpiece, the method comprising:

forming the coat with a material constituting the electrode or a substance that is generated by a reaction of the material due to the pulse electrical discharge, wherein:

the electrode is formed by compression-molding and heating a powder comprising a metallic powder or a metallic compound powder having an average grain diameter of 2 micrometers to 6 micrometers and containing 40% volume or more of a metallic material, the coat contains the metallic powder or the metallic compound powder as a result of the reaction generated under conditions of a width of a current pulse for the pulse electrical discharge in a range of 5 microseconds to 100 microseconds and a peak of the current pulse in a range of 2 amperes to 30 amperes, and the metallic material is as likely or less likely to be carbonized than at least one of Co, Fe, and Ni, wherein the coat with an acceptable adhesion force is formed without prior and further depositions or spraying.

5. The electrical-discharge surface-treatment method according to claim 4, wherein the electrode comprises:

the metallic material comprising one of Co, Fe, and Ni and another metal that is harder than the metallic material.

6. The electrical-discharge surface-treatment method according to claim 4, wherein the metallic powder or the metallic compound powder have any one of compositions of 20 weight % of chrome, 10 weight % of nickel, 15 weight % of tungsten, and rest of cobalt; 25 weight % of chrome, 10 weight % of nickel, 7 weight % of tungsten, and rest of cobalt;

28 weight % of molybdenum, 17 weight % of chrome, 3 weight % of silicon, and cobalt;

15 weight % of chrome, 8 weight % of iron, and rest of nickel;

21 weight % of chrome, 9 weight % of molybdenum, 4 weight % of tantalum, and rest of nickel; and 19 weight % of chrome, 53 weight % of nickel, 3 weight % of molybdenum, 5 weight % of columbium+tantalum, 0.8 weight % of titanium, 0.6 weight % of aluminum, and rest of iron.

7. The electrical-discharge surface-treatment method according to claim 1, further comprising forming the coat using the electrode such that the coat has the metallic powder or the metallic compound as a main component of the coat.

8. The electrical-discharge surface-treatment method according to claim 1, wherein the electrode mostly excludes powders with average grain diameter greater than 3 micrometers.

9. The electrical-discharge surface-treatment method according to claim 1, wherein the electrode is formed by heating the powder to approximately 800-900° C. after the compression molding.

10. The electrical-discharge surface-treatment method according to claim 1, further comprising removing wax at a low temperature prior to the heating.

11. The electrical-discharge surface-treatment method according to claim 1, wherein the powder is not mixed with a wax prior to the heating.

12. The electrical-discharge surface-treatment method according to claim 1, wherein the electrode is formed by heating the powder using a heating temperature in a range of about 200° C.-250° C. after the compression molding.

13. The electrical-discharge surface-treatment method according to claim 1, wherein the electrode is formed by heating the powder at a predetermined temperature for approximately at least one hour in a vacuum furnace after the compression molding.

14. The electrical-discharge surface-treatment method according to claim 4, wherein the electrode is formed by heating the powder at a temperature of approximately 800°-900° C.

15. An electrical-discharge surface-treatment method for forming a coat on a surface of a workpiece using a pulse electrical discharge between an electrode and the workpiece, the method comprising:

forming a powder comprising a metallic powder or a metallic compound powder having an average grain diameter of 3 micrometers or less and further containing a base material powder having an average grain diameter of 3 micrometers or less; wherein 40% volume or more of the powder is a metallic material;

compressing the powder, to form an electrode by molding;

applying pulse electrical discharge between the formed electrode and the workpiece to form the coat, the coat being comprised of the metal or metals of the powder, the coat being formed as a result of the reaction generated under conditions such that a width of a current pulse of the pulse electrical discharge is less than or equal to 70 microseconds and a peak of the current of the pulse is in a range of 2 amperes to 30 amperes, wherein the metallic material is selected from the group of metals which are as likely or less likely to be carbonized than at least one of Co, Fe, and Ni.

16. The method of claim 15, wherein the compression molding of the powder occurs during or is followed by heating of the compressed mixture.

17. The method of claim 15, wherein the coat is formed without further depositions or spraying.

18. The method of claim 1, wherein the coat of an acceptable adhesion force is formed without further depositions or spraying.

19. The method of claim 1, wherein the compression molding of the powder occurs during or is followed by heating of the compressed mixture.

20. The method of claim 1, further comprising mixing wax with the powder prior to the compression molding and removing the wax from the powder at a low temperature prior to the heating.

* * * * *